US009307806B1

(12) United States Patent
Dorman et al.

(10) Patent No.: US 9,307,806 B1
(45) Date of Patent: Apr. 12, 2016

(54) BUTTON FASTENER SYSTEM

(71) Applicants: Lee Fisher Dorman, Pikesville, MD (US); Louis Bruce Hornstein, Pikesville, MD (US)

(72) Inventors: Lee Fisher Dorman, Pikesville, MD (US); Louis Bruce Hornstein, Pikesville, MD (US)

(73) Assignee: Lee Fisher Dorman, Pikesville, MD (US)

( * ) Notice: Subject to any disclaimer, the term of this patent is extended or adjusted under 35 U.S.C. 154(b) by 0 days.

(21) Appl. No.: 14/805,049

(22) Filed: Jul. 21, 2015

Related U.S. Application Data

(60) Provisional application No. 62/078,088, filed on Nov. 11, 2014.

(51) Int. Cl.
*A44B 1/14* (2006.01)
*A44B 17/00* (2006.01)
*A41F 1/00* (2006.01)

(52) U.S. Cl.
CPC . *A44B 1/14* (2013.01); *A41F 1/002* (2013.01); *A44B 17/0005* (2013.01); *A44B 17/0041* (2013.01)

(58) Field of Classification Search
CPC ... Y10T 24/32; Y10T 24/367; Y10T 24/3672; Y10T 24/3497; A44B 1/14; A44B 17/0005; A44B 17/0041; A41F 1/002
See application file for complete search history.

(56) References Cited

U.S. PATENT DOCUMENTS

| | | | | |
|---|---|---|---|---|
| 2,483,031 | A * | 9/1949 | Avedon | A44B 5/02 24/303 |
| 5,048,160 | A * | 9/1991 | Goodrich | A41H 37/001 24/114.6 |
| 5,060,356 | A | 10/1991 | Szedzinski | |
| 5,161,285 | A | 11/1992 | Jerjian | |
| 5,347,688 | A | 9/1994 | Ross | |
| 8,667,650 | B1 | 3/2014 | Duffin | |
| 2006/0156518 | A1 | 7/2006 | Frank | |
| 2013/0291340 | A1* | 11/2013 | Hoffman | A44B 1/18 24/114.4 |

FOREIGN PATENT DOCUMENTS

KR 200458065 Y1 1/2012

OTHER PUBLICATIONS

ISR dated Oct. 30, 2015.

* cited by examiner

*Primary Examiner* — Robert J Sandy

(57) ABSTRACT

A button fastening apparatus is provided. The button fastening apparatus includes at least a first and second assemblies and a method for converting button-style fasteners to push-pull detachable fasteners, enabling individuals with limited manual dexterity to wear the button-up clothes they desire. The first assembly may be dimensioned and adapted to attach a magnetic portion thereof to any button-style fastener. The second assembly may form a cover portion interconnected to a ferromagnetic portion through a button placket, so that the first and second assemblies may be easily removably secured via a push-pull detachable fastener system, which subsumes the button-style fastener.

20 Claims, 10 Drawing Sheets

BUTTON FASTENER SYSTEM

CROSS-REFERENCE TO RELATED APPLICATION

This application claims the benefit of priority of U.S. provisional application No. 62/078,088, filed 11 Nov. 2014, the contents of which are herein incorporated by reference.

BACKGROUND OF THE INVENTION

The present invention relates to fasteners and systems thereof and, more particularly, to a button fastening system that embodies devices and a method for converting button-style fasteners to push-pull detachable fasteners, thereby enabling individuals that are physically challenged or otherwise have limited manual dexterity to wear the button-up clothes they desire.

People who are physically challenged or otherwise have limited manual dexterity, particularly those with limited fine motor skills, sometimes have difficulty buttoning their own clothes. This can be distressing when such a person wants to attend an event requiring formal attire or otherwise desires to dress in a desired article of button-up clothing. Typically, in such situations, such a person would need the assistance of a caregiver at the time of dressing up.

As can be seen, there is a need for a button fastening system that embodies devices and a method for converting button-style fasteners to push-pull detachable fasteners, thereby enabling individuals that are physically challenged or otherwise have limited manual dexterity to wear the button-up clothes they desire.

SUMMARY OF THE INVENTION

In one aspect of the present invention, button fastening apparatus for converting button-style fasteners to push-pull detachable fastener includes a first assembly having an attaching portion for securing to at least a portion of a button of the button-style fastener; and a first fastening portion; and a second assembly having a cover portion for engaging a button hole of the button-style fastener; and a second fastening portion adapted to removably attached to the first fastening portion.

These and other features, aspects and advantages of the present invention will become better understood with reference to the following drawings, description and claims.

DETAILED DESCRIPTION OF THE INVENTION

Figure 1:
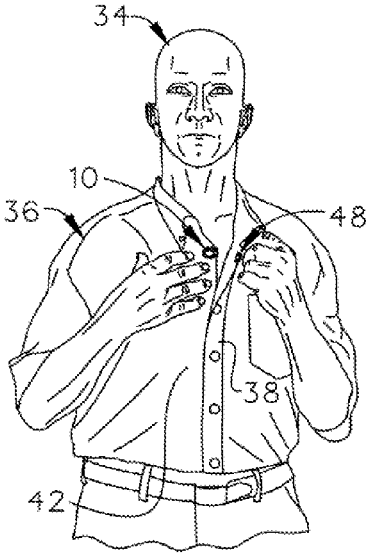
FIG. 1 is a perspective view of an exemplary embodiment of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a button fastening system that embodies at least a first and second assemblies and a method for converting button-style fasteners to push-pull detachable fasteners, enabling individuals with limited manual dexterity to wear the button-up clothes they desire. The first assembly may be dimensioned and adapted to attach a magnetic portion thereof to any button-style fastener. The second assembly may form a cover portion interconnected to a ferromagnetic portion through a button placket, so that the first and second assemblies may be easily removably secured via a push-pull detachable fastener system, which subsumes the button-style fastener.

Referring now to FIGS. 1 through 16, the present invention may a button fastening system 100 that embodies a first assembly 10, a second assembly 48 and a method for converting a button-style fastener 44 to push-pull detachable fasteners, thereby enabling an individual 34 having limited manual dexterity to wear the button-up article of clothing 36 they desire. The button-up article of clothing 36 may include a shirt, pants, blouse, coat, hat or any type of article clothing utilizing at least one standard button for fastening or removably securing one object to another. Generally, the button-style fastener 44 may be connected to a button panel 42 via button threading 46 or an equivalent fastener, and the button-style fastener 44 may be dimensioned and adapted to operatively engage a button placket 40 disposed on an opposing buttonhole panel 36.

Figure 3:
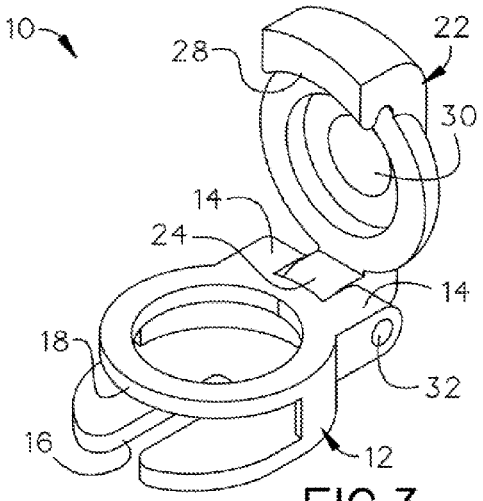
FIG. 3 is a top perspective view of an exemplary embodiment of the present invention, illustrating a first assembly in an open configuration.

The first assembly 10 may include an attaching portion 12 and a first fastening portion 22. The attaching portion 12 may be adapted to removably attach to a button-style fastener 44. In certain embodiments, the attaching portion 12 may define an enclosure dimensioned and adapted to secure at least a portion of the button-style fastener 44 therein. The enclosure may also be at least defined by a first bottom sheet and an opposing top sheet 18, as illustrated in FIG. 3. The bottom sheet may form a bottom slot 16, as illustrated in FIG. 3. The bottom slot 16 may be dimensioned and adapted for slidably receiving the button threading 46 connecting the button-style fastener 44 to the article of button-up clothing 36. The attaching portion 12 may form at least one external (relative to the enclosure) hinge arm 14. Each hinge arm 14 may form an aligned pin hole 20.

Figure 6:
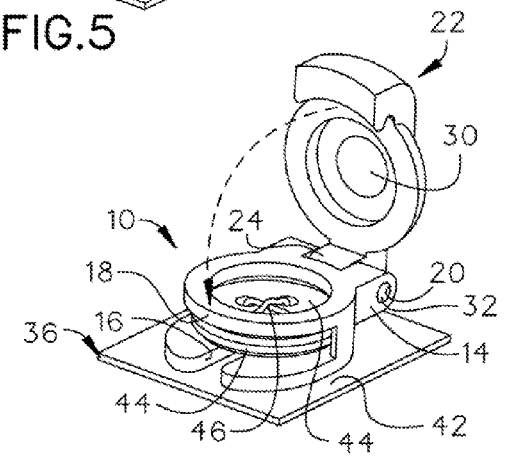
FIG. 6 is a perspective detail view of an exemplary embodiment of the first assembly of the present invention, shown moving from the open configuration to a closed configuration.
Figure 8:
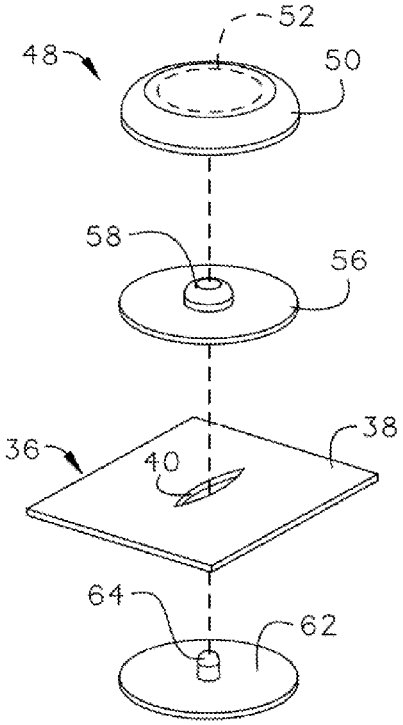
FIG. 8 is a top perspective exploded view of an exemplary embodiment of a second assembly of the present invention.

The first fastening portion 22 may be pivotably connected to the attaching portion 12. The first fastening portion 22 may form a top cap hinge arm 24 extending from the first fastening portion 22, wherein the hinge arm 24 is dimensioned and adapted to cooperate with the at least one external hinge arm 14 so that the first fastening portion 22 is movable from an open configuration (FIGS. 3-5) and a closed configuration (FIGS. 7, 10 and 11), as illustrated in FIG. 6. A hinge pin hole 26 may be formed within the hinge arm 24 so that a pin 32 may be slidably received through the hinge pin hole 26 and each aligned pin hole 20.

Figure 7:
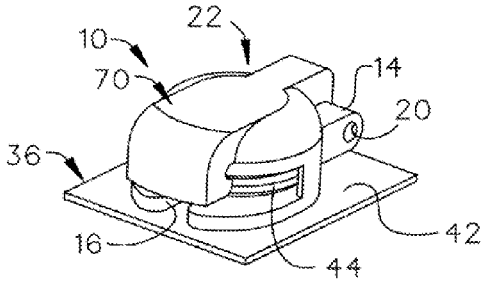
FIG. 7 is a perspective detail view of an exemplary embodiment of the present invention, illustrating the first assembly in the closed configuration.
Figure 9:
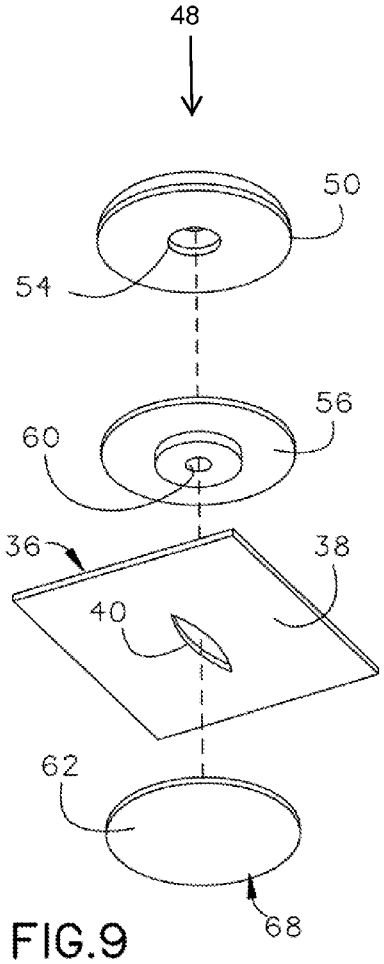
FIG. 9 is a bottom perspective exploded view of an exemplary embodiment of the second assembly of the present invention.
Figure 10:
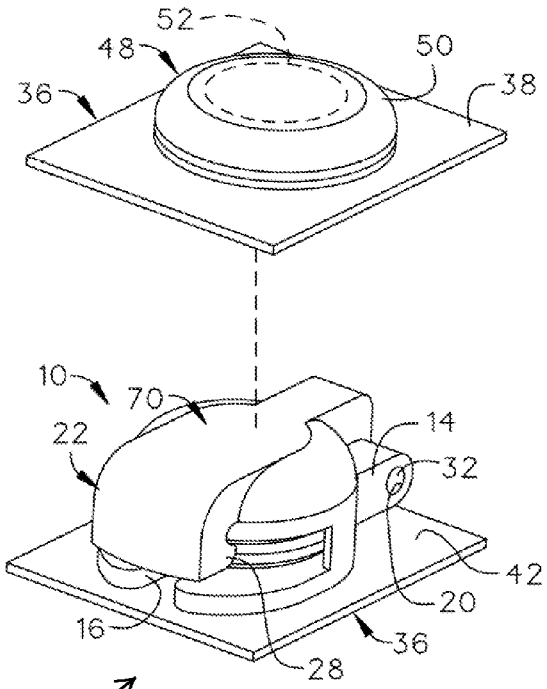
FIG. 10 is an exploded detail view of an exemplary embodiment of the present invention, showing the first and second assemblies in use.
Figure 17:
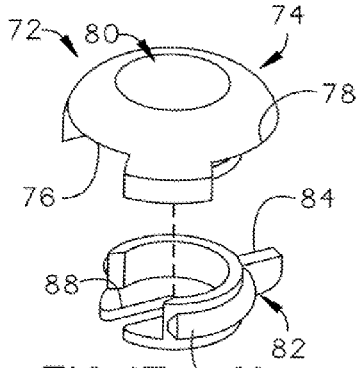
FIG. 17 is an exploded view of an exemplary embodiment of an alternative first and second assembly of the present invention, shown in use.
Figure 18:
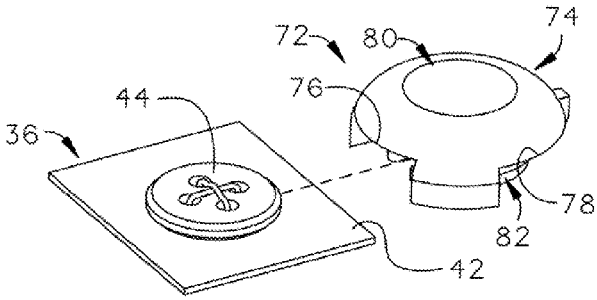
FIG. 18 is an exploded view of an exemplary embodiment of the present invention, shown in use.
Figure 19:
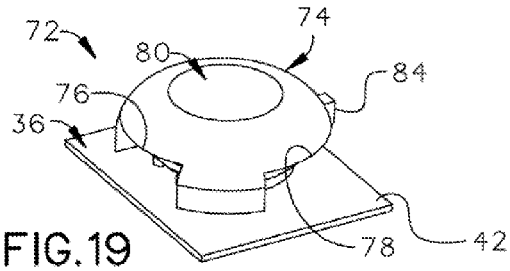
FIG. 19 is a perspective view of an exemplary embodiment of the present invention.

In certain embodiments, the first fastening portion 22 may be dimensioned and adapted so that its periphery is relative flush with a periphery of the attaching portion 12. A top cap snap rim 28 may be disposed along a periphery of the first fastening portion 22, wherein the snap rim 28 may be dimensioned and adapted to securely (or snap) engage a periphery of the top plate 18 in the closed configuration. A magnet 30 may be disposed within the first fastening portion 22 so as to produce a magnetized portion 70 or 80, as illustrated in FIG. 7 and FIG. 17, respectively. Alternatively, the magnetized portions 70, 80 may be magnetized without the presence of the magnet 30.

Referring to FIGS. 9 through 16, the second assembly 48 may include a cover portion 50 interconnected to a second fastening portion 62. In certain embodiments, an intermediate plate 56 may interconnect the cover portion 50 and the second fastening portion 62. The cover portion 50 may have an upward facing decorative region 52 and an opposing, downward facing female cavity 54. The intermediate plate 56 may form an upward-facing intermediate male protrusion 58 and an opposing downwardly-facing intermediate female cavity 60, wherein the intermediate male protrusion 58 may be adapted and dimensioned to removably ("snap") secure into the female cavity 54. The second fastening portion 62 made of any suitable ferromagnetic material, such as, but not limited to metal, at least along a portion of a downward-facing backing surface 68. The second fastening portion 62 may form an upward-facing, opposite the backing surface 68, a male protrusion 64 adapted and dimensioned to removably ("snap") secure to the intermediate female cavity 60. In certain embodiments, the second fastening portion 62 may sandwich the buttonhole panel 38 and the intermediate plate 56 between the cover portion 50 so that the male protrusion 64 protrudes through the button placket 40 and into the intermediate female cavity 60, while the intermediate male protrusion 58 is secured within the female cavity 60. In another embodiment, the intermediate plate 56 may not be included into this second assembly sandwich.

Figure 11:
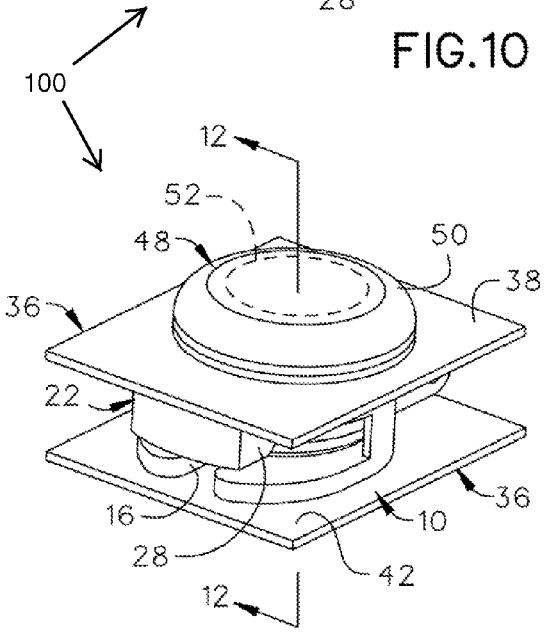
FIG. 11 is a perspective view of an exemplary embodiment of the present invention.
Figure 12:
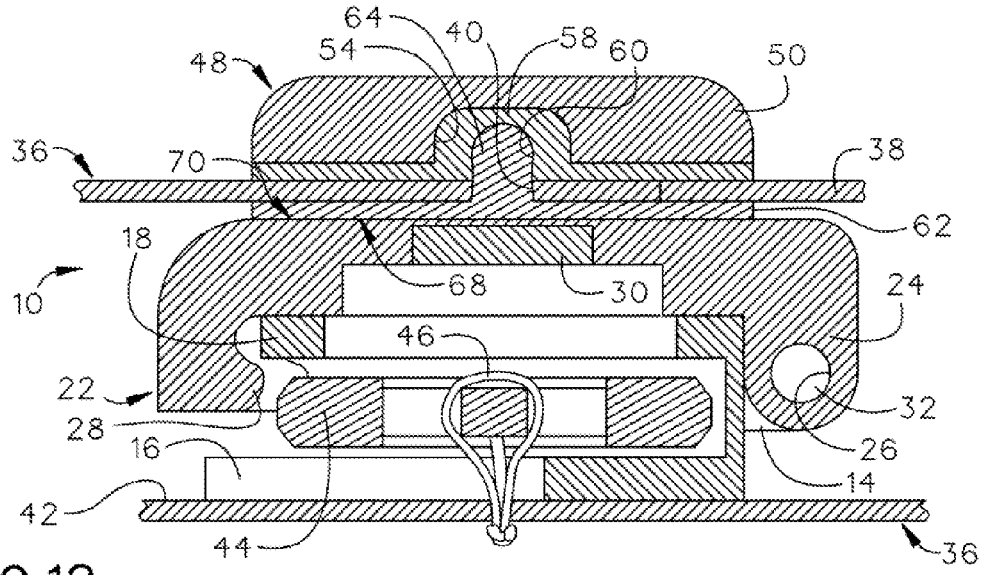
FIG. 12 is a section detail view of an exemplary embodiment of the present invention, taken along line 12-12 in FIG. 11.

The second assembly 48 may cooperate with the first assembly 10, wherein the second fastening portion 62 may removably secure to the first fastening portion 22. In certain embodiments, the second fastening portion 62 may provide a ferromagnetic downward-facing backing surface 68 that magnetically connects to the magnetized portion 70, as illustrated in FIG. 11. Also adapted to cooperate with the first assembly 10 may be an alternative first assembly 72, wherein certain embodiments the magnetized portion 80 removably secures to the ferromagnetic downward-facing backing surface 68.

The alternative first assembly 72 may form a snap fastening portion 74 and a cooperating snap attaching portion 82. The snap attaching portion 82 may define an enclosure dimensioned and adapted to secure a cooperating button-style fastener 44 therein. The enclosure may also be defined by an alternative bottom sheet, forming a bottom slot 88, as illustrated in FIG. 17. The bottom slot 88 is dimensioned and adapted for sliding receiving the button threading 46 connecting the button-style fastener 44 to the article of button-up clothing 36. The snap attaching portion 82 may form at least one external (relative to the enclosure) housing rail 86 along a portion of a periphery of the snap attaching portion 82. The snap attaching portion 82 may form a lever 84 extending radial like the housing rail 86 but protruding beyond a perimeter of said housing rail 86, as illustrated in FIG. 17.

Figure 20:
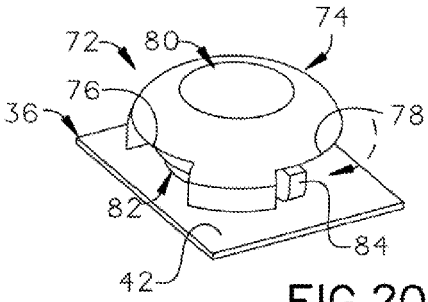
FIG. 20 is a perspective view of an exemplary embodiment of the present invention, shown in use.
Figure 21:
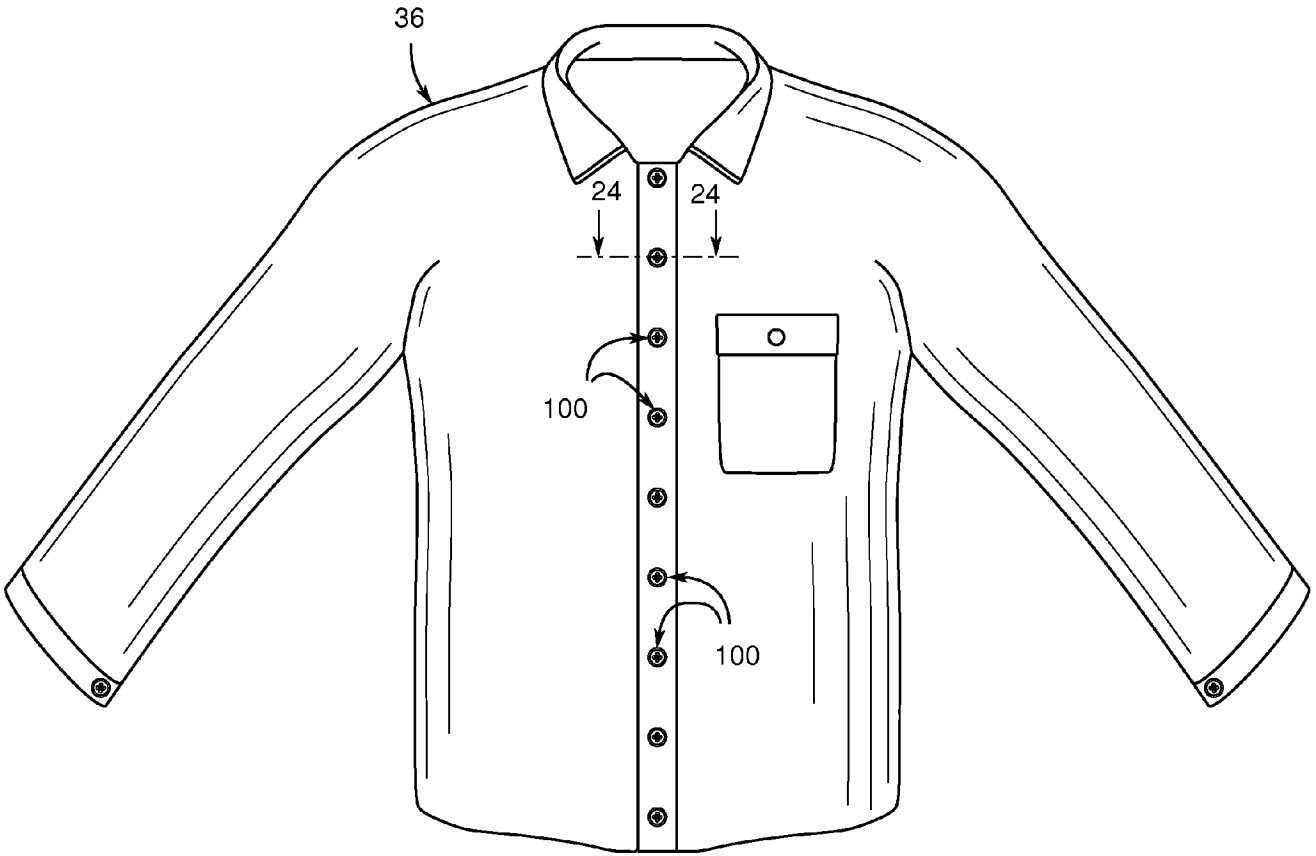
FIG. 21 is a front elevation view of an exemplary embodiment of the present invention, shown in use.
Figure 22:
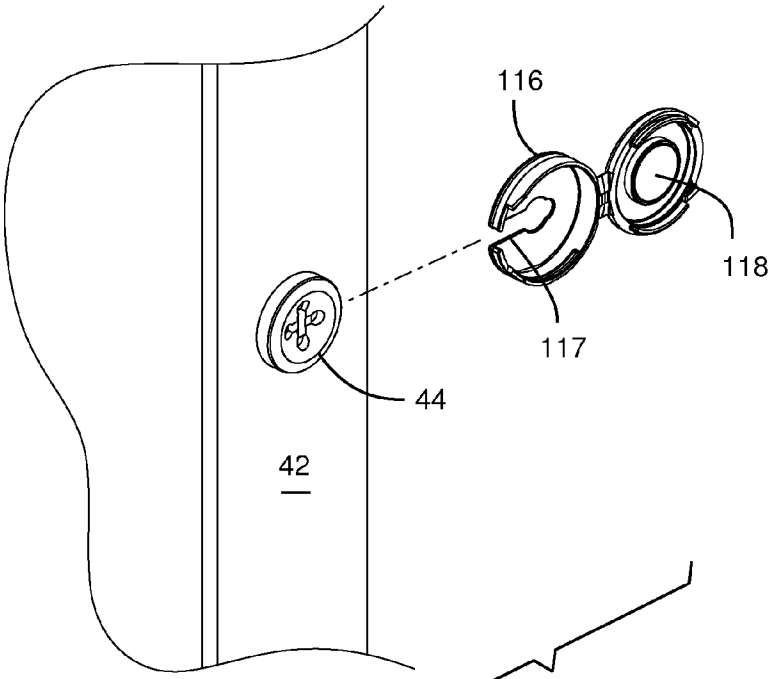
FIG. 22 is an exploded view of an exemplary embodiment of the present invention, illustrating an alternative first assembly in the opened configuration shown in use.
Figure 23:
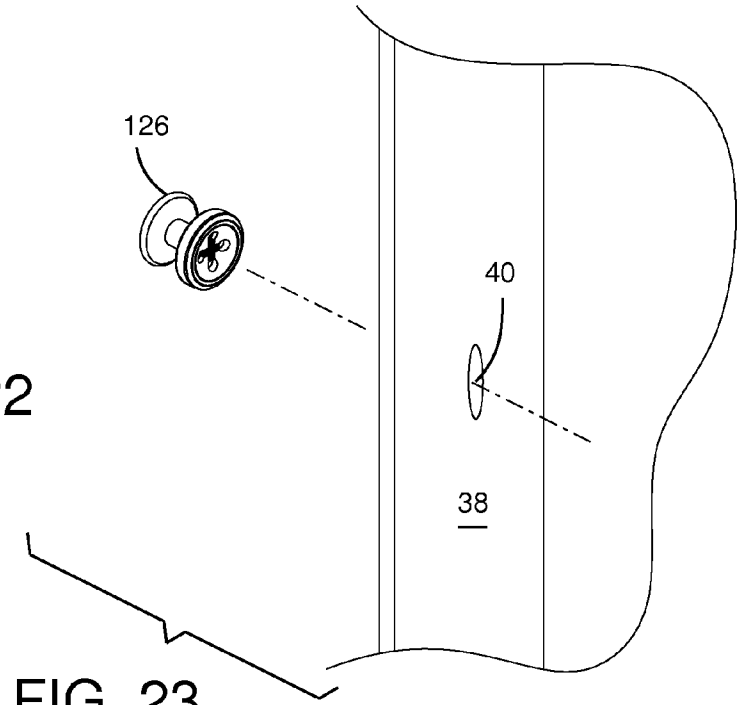
FIG. 23 is an exploded view of an exemplary embodiment of the present invention, illustrating an alternative second assembly shown in use.

The snap fastening portion 74 may be dimensioned and adapted to have a periphery greater than the snap housing 82. The snap fastening portion 74 may form a plurality of angled flanges extending from said periphery so as to extend over and beyond a perimeter of the housing rail 86 so as to angle back underneath, forming a track dimensioned and adapted to slide about the housing rail 86. While sliding along the housing rail 86, the lever 84 may ride with a lever slot 78 formed within the snap fastening portion 74, as illustrated in FIG. 20. The snap fastening portion 74 may form a magnetized portion 80, as illustrated in FIGS. 17-20. The snap fastening portion 74 may provide a magnet disposed therein for producing the magnetized portion 80. Alternatively, the magnetized portion 80 may be inherently magnetic.

Figure 13:
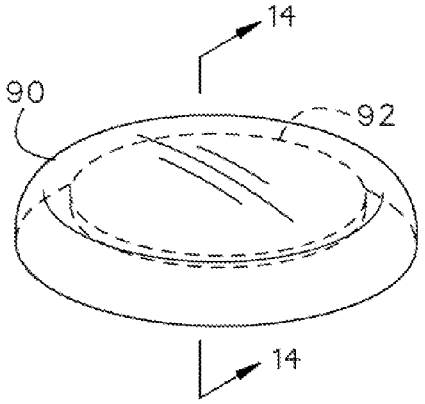
FIG. 13 is a perspective view of an exemplary embodiment of the present invention.
Figure 14:
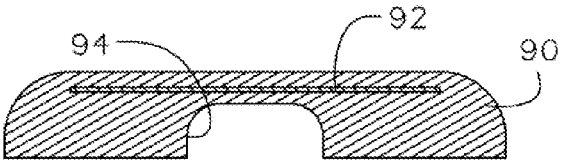
FIG. 14 is a section view of an exemplary embodiment of the present invention, taken along line 14-14 in FIG. 13.
Figure 15:
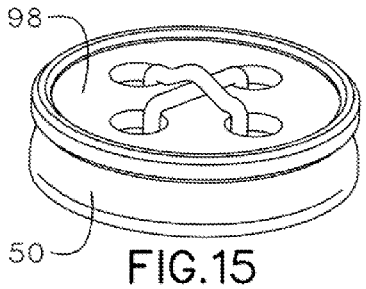
FIG. 15 is a perspective view of an exemplary embodiment of the present invention.
Figure 16:
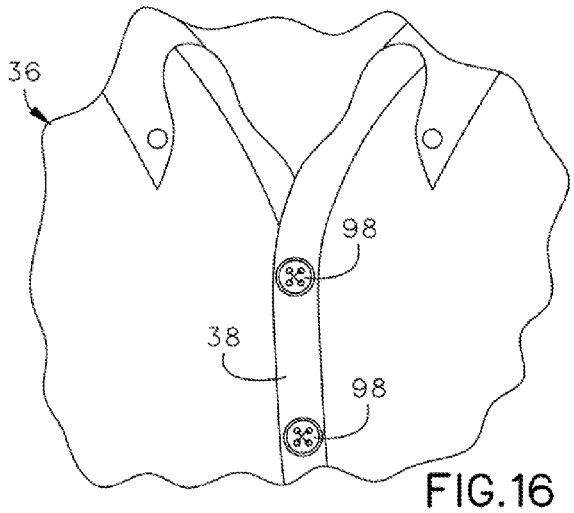
FIG. 16 is a front view of an exemplary embodiment of the present invention, shown in use.

An alternative cover portion 90, as illustrated in FIG. 13, may include a decorative plate 92 providing an upward facing decorative region. The cover portion 90 may form a downward facing female cavity 94 dimensioned and adapted to removably ("snap") secure to the intermediate male protrusion 58, thereby allowing the individual 34 to interchange different cover portions 50, 90 that include display art deco, personal pictures, personal messages, organized team logos, military insignias and the like. The present invention also includes cover portions that mimic button-style fasteners, such as faux button designs 98.

Figure 24:
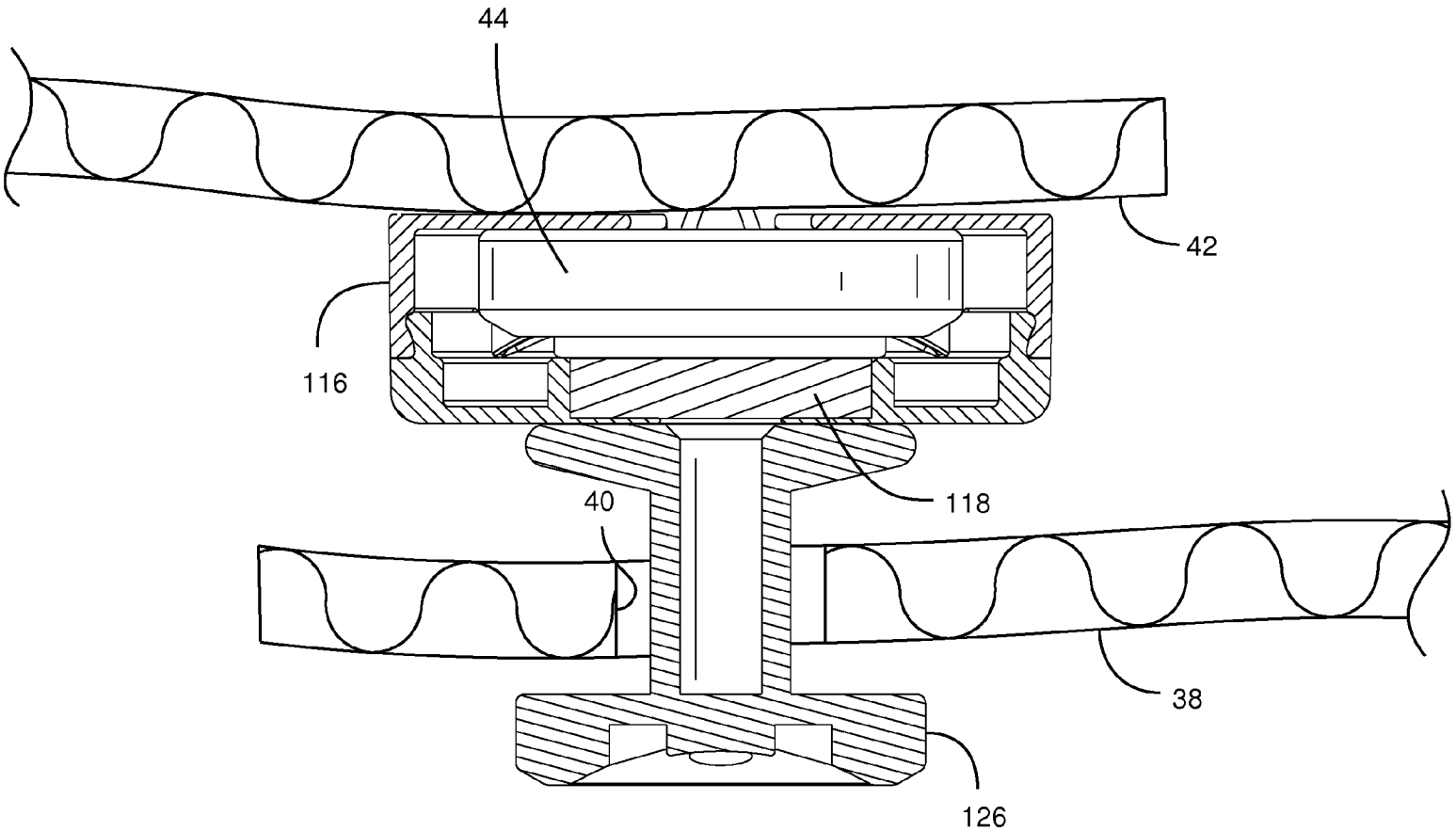
FIG. 24 is a cross-sectional view of an exemplary embodiment of the present invention, taken along line 24-24 in FIG. 21.
Figure 26:
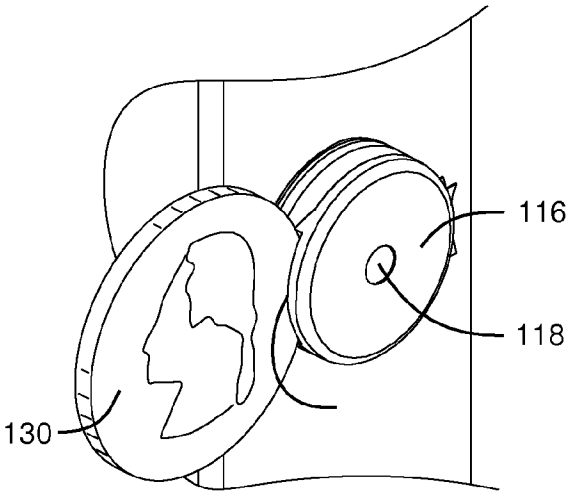
FIG. 26 is a perspective view of an exemplary embodiment of the present invention, shown in use.
Figure 27:
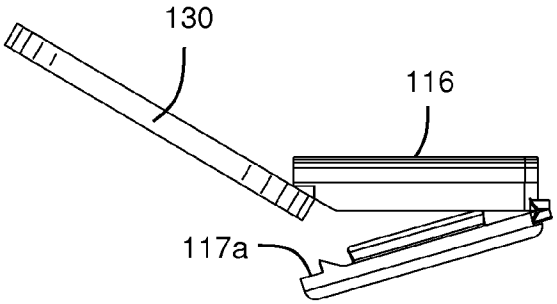
FIG. 27 is a side view of an exemplary embodiment of the present invention, shown in use.
Figure 25:
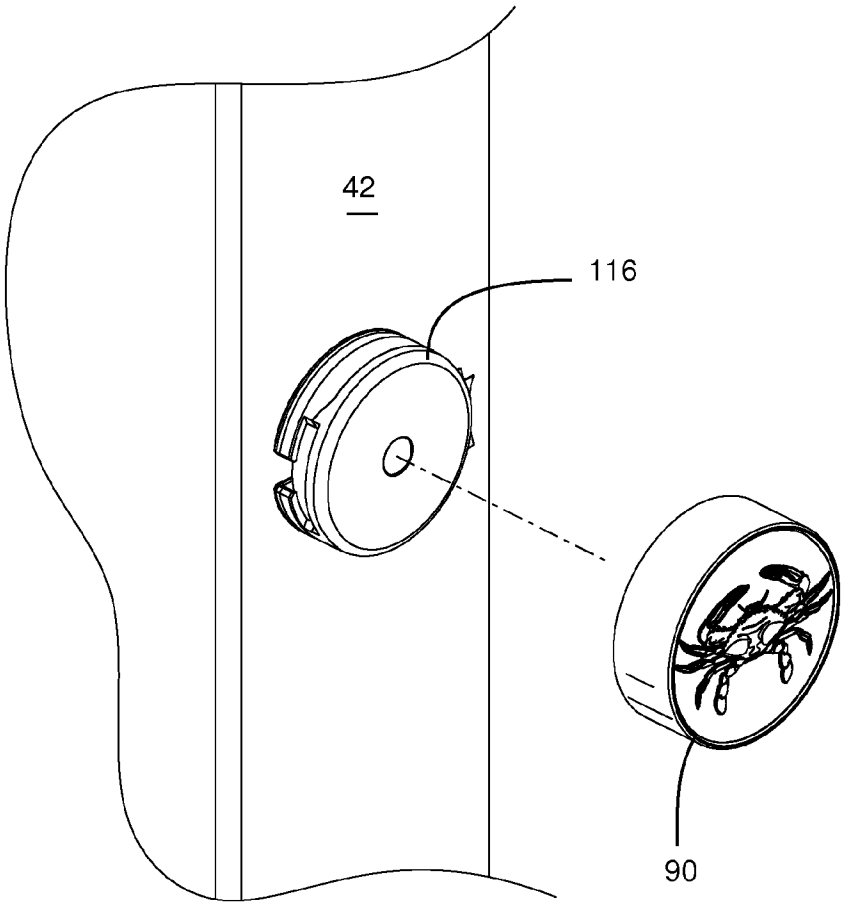
FIG. 25 is an exploded detail view of an exemplary embodiment of the present invention.
Figure 28:
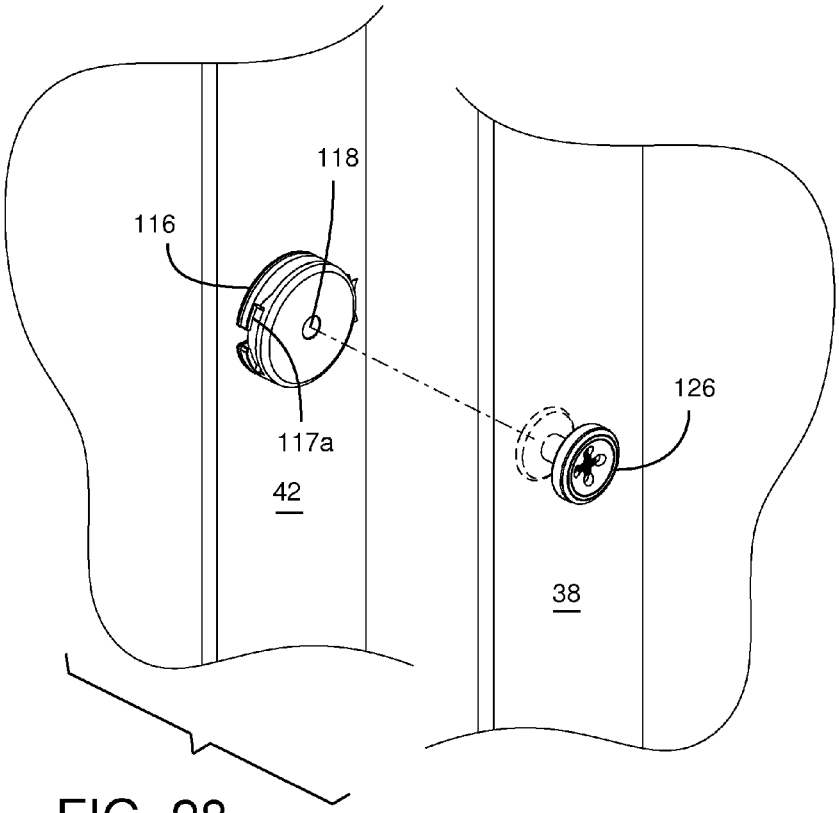
FIG. 28 is a perspective view of an exemplary embodiment of the present invention, shown in use.
Figure 29:
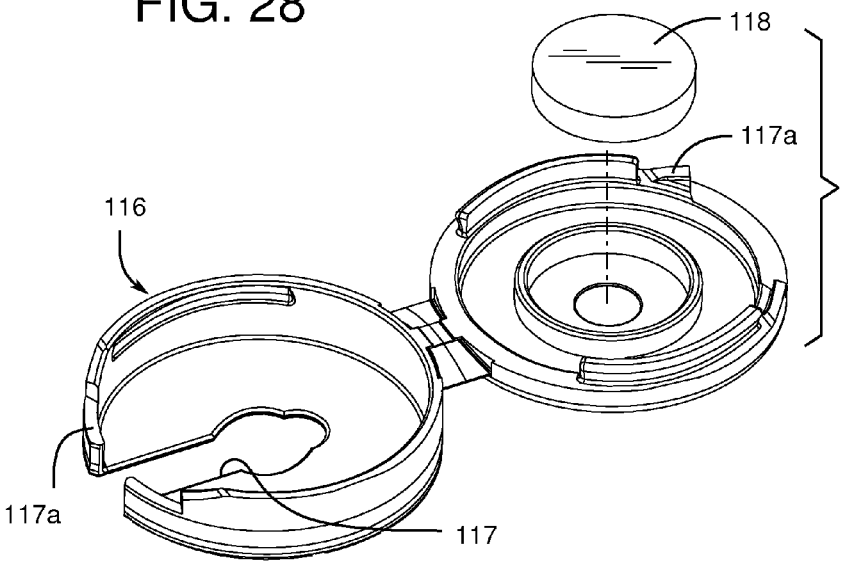
FIG. 29 is a perspective exploded view of an exemplary embodiment of an alternative embodiment of the present invention.

Referring to FIGS. 21 through 29, an alternative embodiment of the present invention may be provided. An alternative first assembly and an alternative second assembly 126 may similarly cooperate. The alternative first assembly may include an alternative attaching portion 116 pivotally connected to a an alternative fastening portion for moving to the closed configuration to secure a button-style fastener 44. The alternative attaching portion 116 may form an alternative bottom slot 117 for securing to the threading 46 of the button style fastener 44. The alternative fastening portion may provide a magnet 118 for securing to the alternative second assembly 126, as illustrated in FIG. 24. The alternative first assembly 116 may form a latch notch 117*a* along its periphery, wherein the latch notch 117*a* may be adapted to enable a makeshift lever 130, like a coin, to move the alternative first assembly from the closed configuration to its open configuration, as illustrated in FIGS. 26 and 27.

Figure 2:
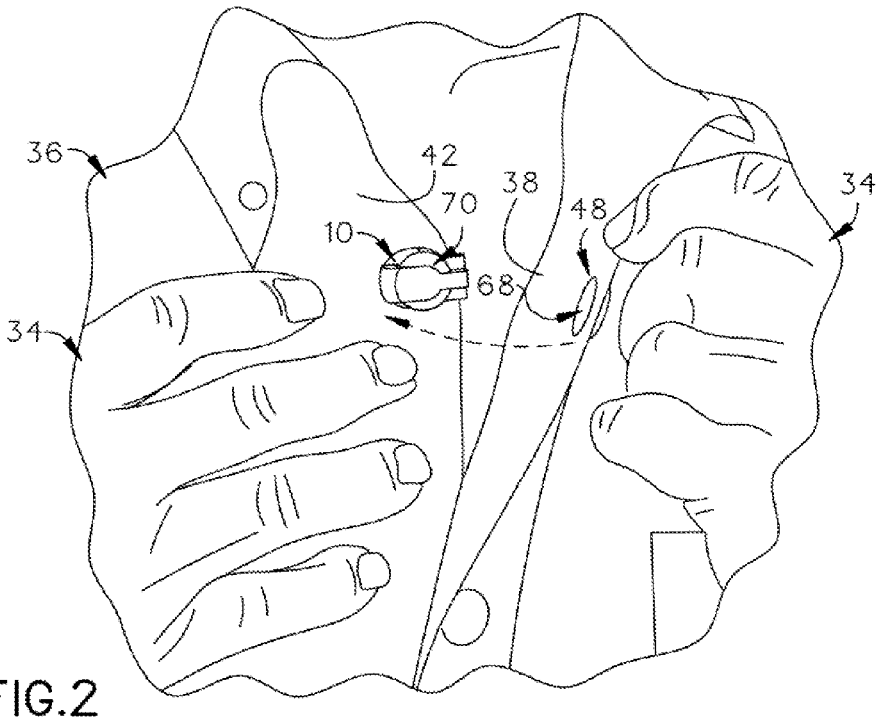
FIG. 2 is a detailed perspective view of an exemplary embodiment of the present invention, shown in use.
Figure 4:
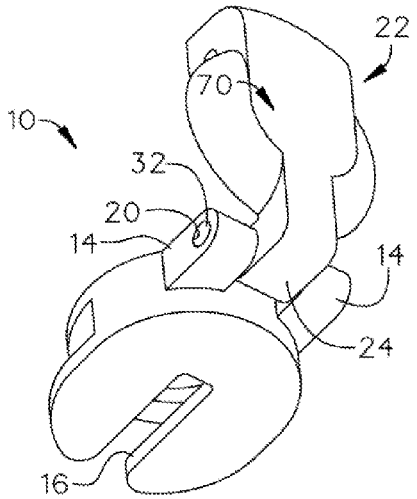
FIG. 4 is a bottom perspective view of an exemplary embodiment of the present invention, illustrating the first assembly in the open configuration.
Figure 5:
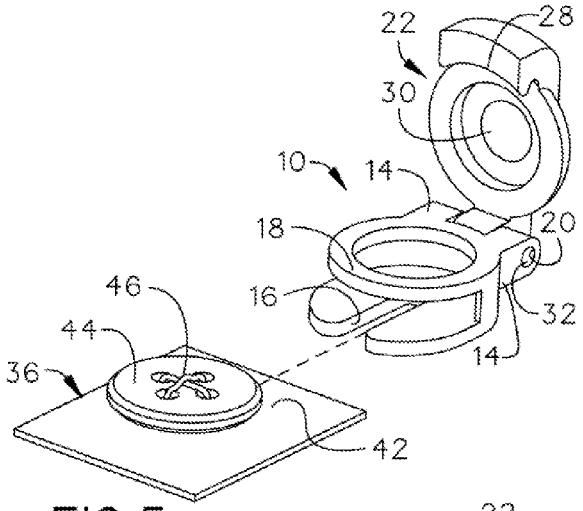
FIG. 5 is an exploded detail view of an exemplary embodiment of the first assembly of the present invention, shown in use.

A method of using the present invention may include the following. The first assembly 10 disclosed above may be provided. A user may slide the button threading 46 into the bottom slot 16 so that the attaching portion 12 secures to the button-style fastener 44. In certain embodiments, the first fastening portion 22 is positioned in the closed configuration so that the first fastening portion 22 and the attaching portion 12 come into locking engagement. Then the user may engage the button placket 40 and the second assembly 48 so that the cover portion 50 is outward facing and that the second fastening portion 62 magnetically engages the magnetized portion 70 of the first assembly, or otherwise attaches thereto. Once the user has applied the first assembly 10, a physically challenged operator 34 can dress themselves without the assistance of a caregiver by easily detachably engage or disengaged the magnetized portion 70 (or the magnetized portion 80) and the second fastening portion 62 by a simple push-pull movement, as illustrated in FIG. 2.

It should be understood, of course, that the foregoing relates to exemplary embodiments of the invention and that modifications may be made without departing from the spirit and scope of the present invention.

What is claimed is:

1. A button fastening apparatus for converting button-style fasteners to push-pull detachable fastener, comprising:
- a first assembly comprising:
  - an attaching portion for securing to at least a portion of a button of the button-style fastener; and
  - a first fastening portion; and
- a second assembly comprising:
  - a cover portion for engaging a button hole of the button-style fastener; and
  - a second fastening portion adapted to removably attached to the first fastening portion, wherein the second fastening portion comprises a ferromagnetic material.

2. The button fastening apparatus of claim 1, wherein the cover portion and the second fastening portion are configured to sandwich the button hole.

3. The button fastening apparatus of claim 2, further comprising:
- a male protrusion extending from the second fastening portion; and
- a female cavity formed in the cover portion, wherein the female cavity is dimensioned and adapted to removably mate with the male protrusion, and
- wherein the male protrusion protrudes through the sandwiched button hole when removably mating with the female cavity.

4. The button fastening apparatus of claim 3, further comprising an intermediate plate interconnecting the cover portion and the second fastening portion.

5. The button fastening apparatus of claim 4, wherein the intermediate plate further comprises a intermediate female cavity and an opposing intermediate male protrusion.

6. The button fastening apparatus of claim 1, further comprising an enclosure formed by the attaching portion, wherein the enclosure is dimensioned and adapted to securely enclose the at least a portion of the button.

7. The button fastening apparatus of claim 6, wherein the attaching portion is pivotably connected to the first fastening portion so as to be movable between an open configuration and a closed configuration securely enclosing the at least a portion of the button.

8. The button fastening apparatus of claim 6, wherein the attaching portion forms a bottom slot for slidably receiving a button threading of the button-style fastener within the enclosure.

9. A button fastening apparatus for converting button-style fasteners to push-pull detachable fastener, comprising:
- a first assembly comprising:
  - an attaching portion for securing to at least a portion of a button of the button-style fastener;
  - an enclosure formed by the attaching portion, wherein the enclosure is dimensioned and adapted to securely enclose the at least a portion of the button; and
  - a first fastening portion; and
- a second assembly comprising:
  - a cover portion for engaging a button hole of the button-style fastener; and
  - a second fastening portion adapted to removably attached to the first fastening portion.

10. The button fastening apparatus of claim 9, wherein the second fastening portion comprises a ferromagnetic material.

11. The button fastening apparatus of claim 10, further comprising a magnetic portion disposed on the first fastening portion.

12. The button fastening apparatus of claim 9, wherein the attaching portion is pivotably connected to the first fastening portion so as to be movable between an open configuration and a closed configuration securely enclosing the at least a portion of the button.

13. The button fastening apparatus of claim 9, wherein the attaching portion forms a bottom slot for slidably receiving a button threading of the button-style fastener within the enclosure.

14. A button fastening apparatus for converting button-style fasteners to push-pull detachable fastener, comprising:
- a first assembly comprising:
  - an attaching portion for securing to at least a portion of a button of the button-style fastener; and
  - a first fastening portion; and
- a second assembly comprising:
  - a cover portion for engaging a button hole of the button-style fastener;
  - a second fastening portion adapted to removably attached to the first fastening portion, wherein the cover portion and the second fastening portion are configured to sandwich the button hole a male protrusion extending from the second fastening portion; and a female cavity formed in the cover portion, wherein the female cavity is dimensioned and adapted to removably mate with the male protrusion, wherein the male protrusion protrudes through the sandwiched button hole when removably mating with the female cavity.

15. The button fastening apparatus of claim 14, further comprising an intermediate plate interconnecting the cover portion and the second fastening portion.

16. The button fastening apparatus of claim 15, wherein the intermediate plate further comprises a intermediate female cavity and an opposing intermediate male protrusion.

17. The button fastening apparatus of claim 14, further comprising a magnetic portion disposed on the first fastening portion.

18. The button fastening apparatus of claim 14, further comprising an enclosure formed by the attaching portion.

19. The button fastening apparatus of claim 18, wherein the attaching portion is pivotably connected to the first fastening portion so as to be movable between an open configuration and a closed configuration securely enclosing the at least a portion of the button.

20. The button fastening apparatus of claim 18, wherein the attaching portion forms a bottom slot for slidably receiving a button threading of the button-style fastener within the enclosure.

* * * * *